United States Patent [19]

Fishwick et al.

[11] Patent Number: 4,720,261

[45] Date of Patent: Jan. 19, 1988

[54] EXPLOSION RELIEF PANEL

[75] Inventors: Alan J. Fishwick; Robert K. Jackson; Anthony J. Wilson, all of Bolton, England

[73] Assignee: Metal Box Public Limited Company, Berkshire, England

[21] Appl. No.: 939,782

[22] Filed: Dec. 9, 1986

Related U.S. Application Data

[62] Division of Ser. No. 732,829, filed as PCT GB84/00288, Aug. 20, 1984, Pat. No. 4,654,003.

[30] Foreign Application Priority Data

Aug. 20, 1983 [GB] United Kingdom ..... 8322484

[51] Int. Cl.[4] ..... F27D 21/00; B65D 25/00

[52] U.S. Cl. ..... 432/36; 432/126; 432/144; 220/89 A; 34/66

[58] Field of Search ..... 220/89 A; 432/35, 247; 34/66

[56] References Cited

U.S. PATENT DOCUMENTS

| | | | |
|---|---|---|---|
| 1,227,674 | 5/1917 | Rudolph | 432/35 |
| 1,521,416 | 12/1924 | Ayres . | |
| 1,750,313 | 3/1930 | Emmert | 34/66 |
| 1,930,138 | 10/1933 | Van Der Hoet | 220/89 A |
| 2,170,937 | 8/1939 | Bruning | 220/89 |
| 3,214,844 | 11/1965 | Oates et al. | 34/10 |
| 3,282,578 | 11/1966 | Ulbrich | 432/247 |
| 3,972,442 | 8/1976 | Malcolm | 220/89 A |
| 4,209,295 | 6/1980 | Frahme et al. | 432/247 |
| 4,344,753 | 8/1982 | Shelley et al. | 432/247 |
| 4,414,674 | 11/1983 | Woodruff et al. | 432/247 |
| 4,498,261 | 2/1985 | Wilson et al. | 220/89 A |

FOREIGN PATENT DOCUMENTS

| | | |
|---|---|---|
| 0045417 | 10/1982 | European Pat. Off. . |
| 469544 | 12/1928 | Fed. Rep. of Germany . |
| 2138136 | 2/1973 | Fed. Rep. of Germany . |
| 2137279 | 2/1973 | Fed. Rep. of Germany . |
| 354099 | 8/1931 | United Kingdom . |
| 391025 | 4/1933 | United Kingdom . |
| 1123253 | 8/1968 | United Kingdom . |
| 1207189 | 9/1970 | United Kingdom . |

*Primary Examiner*—Henry C. Yuen

*Attorney, Agent, or Firm*—Christie, Parker & Hale

[57] ABSTRACT

A high-temperature, rapid-cycle pin oven for the curing of coatings on hollow container components, includes an oven unit (2) whose housing (14) is divided into three compartments interconnected by internal explosion relief panels (136,142,144). One of the compartments (36), designed for a normal working pressure in the range 1 to 1.01 atmosphere, has a light explosion-relief panel (132) which provides primary pressure relief to atmosphere while ensuring that if the internal panels blow out, the entire interior is vented to atmosphere. This panel comprises a light casing (202) with thin tin-plate bursting diaphragms (210) in the bottom, overlaid by a light, absorbent mattress (220), and a light top cover (222) which can blow out. A perforated hot air delivery screen (38) forms one wall of the narrow working chamber (34) and comprises a number of plates removably and replaceably fastened to a frame (72) fixed in the housing.

5 Claims, 18 Drawing Figures

14
26
198
196
36
200
132
192
190
194
44
184
130
188
32
186
182
24

XVIII
202
212
132
214
222
208
220
206
204
206
208
224
210
XVIII

XVI
216
218
210
212
210
XVI 226
202
222
224

EXPLOSION RELIEF PANEL

This is a division of application Ser. No. 732,829, filed as PCT GB84/00288, Aug. 20, 1984, now U.S. Pat. 4,654,003.

This invention relates to process apparatus comprising an enclosed housing having at least one internal superatmospheric chamber for containing, in normal operation, gaseous matter at a pressure not more than about 0.01 atmosphere above the ambient pressure; and to explosion relief panels suitable for use as part of such apparatus.

A typical, but non-limiting, example of such process apparatus is an oven for the curing or drying of coatings or printed matter on components made in large quantities: for example, containers such as metal can bodies. Due to the presence of high temperatures and of volatile solvents in such an oven, there is always a risk of internal explosions (which term is to be understood to include any increase in the internal pressure of the oven over that under which it is designed to work in normal operation).

One type of oven for the treatment of metal can bodies in this way is a rapid-cycle pin oven, i.e. an oven which typically consists of an oven unit and a cooler unit arranged in tandem with a common chain-type conveyor, for carrying can bodies on pins projecting laterally from the conveyor chain, extending through first the oven unit and then the cooler unit. Each of the two units of the pin open has a said housing subdivided into an air delivery chamber, a working chamber and an air recirculation chamber. The working chamber lies between the other two chambers, being separated from the former by a perforate air delivery screen, and from the latter by a perforate air recirculation screen. Each unit has means for circulating a forced draught of air through the delivery chamber and thence through the working chamber to the recirculating chamber, the air passing from one chamber to the next through the appropriate one of the screens already mentioned. The oven unit has means for heating the air, which is recirculated in a closed circuit.

Since the treatment air is heated, it will normally contain products of combustion, and the process of curing the coatings on the can bodies involves evaporation of volatile matter from the coatings. To ensure that rapid curing takes place, this volatile matter requires to be positively removed from the vicinity of the can bodies (and therefore from the working chamber of the oven unit). Since the treatment air in the oven unit is recirculated, the volatile matter and combustion products (if any) must be removed from the interior of the oven unit to prevent their concentration building up to amounts such as to affect the curing process. In addition, whilst, in the circumstances prevailing inside a high-temperature curing oven operating on modern can body coatings, there is always some danger of explosion or fire, these risks can be minimised by ensuring that the products likely to give rise to such risks are continuously removed.

Thus the oven unit includes extraction means, which continuously induces a forced draught of scavenging air through the working chamber generally perpendicular to the direction of the treatment of air flow across the working chamber. While combustion products and volatile products are thus continuously removed, so also, inevitably, is a considerable part of the treatment air. To compensate for this, it is essential that fresh air be able to be drawn continuously into the oven unit housing, but in a manner such as not to reduce significantly the temperature in the working chamber.

The oven unit housing is generally in the form of a short and quite narrow enclosure, which is furthermore subdivided into the chambers already mentioned and which, in operation, contains very hot air under forced draught, together with the volatile products and, if the heating means is a fuel burner, combustion products. Under these circumstances the risk of explosion is inevitably enhanced.

According to the invention, in a first aspect, in process apparatus comprising an enclosed housing having at least one internal superatmospheric chamber for containing, in normal operation, gaseous matter at a pressure in the approximate range 1 to 1.01 atmosphere, the said superatmospheric chamber, or at least one of said chambers, has an external explosion relief panel lightly but sealingly held in a through aperture in an external wall of the chamber, the external explosion relief panel comprising a plurality of lightweight elements adapted to deform successively in the event of an explosion, whereby to absorb some of the energy of the explosion and vent the chamber to atmosphere.

The external explosion relief panel preferably comprises a light, box-like casing open at its outer side and its inner side; an explosion panel of thin flexible sheet material within the casing and covering the open inner side of the casing; explosion panel securing means holding the edge only of the explosion panel, so that at least the greater part of the said edge is releasable under overpressure within the associated chamber of the housing; an outer cover of thin flexible sheet material overlying the open outer side of the casing; and outer cover securing means lightly locating the outer cover by only its edge so that the outer cover is releasable outwardly under said overpressure. The external explosion relief panel also preferably includes, within its casing and overlying the explosion panel, a mattress of light, energy-absorbing material.

A friction element is preferably also provided around the edge of the explosion panel so as to provide a frictional resistance to the release of the explosion panel.

The apparatus according to the invention may typically be a thermal treatment unit for the rapid treatment, by forced-air draught, of coatings on a succession of components, and comprising: treatment air circulating means carried by the housing for effecting circulation of treatment air in said forced draught through successive said chambers of the unit; a pair of perforate screens mounted in generally-parallel, non-horizontal planes inside the housing, to define between them a relatively narrow working chamber, being a said superatmospheric chamber; and a conveyor for carrying the components and extending through the working chamber in a plane generally parallel with the planes of the screens, whereby said froced draught of air is directed through a first of said screens and thence over said components being carried by the conveyor through the working chamber, the air leaving the latter through the second of said screens. The oven unit or cooler unit of a rapid-cycle pin oven is an example of thermal treatment apparatus of this kind.

According to a preferred feature of the invention, in a thermal treatment apparatus of the kind set forth above, the said first (or air delivery) screen has a multiplicity of first orifices directed at right angles to the plane of the screen and directly facing the conveyor, the first orifices being distributed in an array extending parallel with at least the greater part of the path of the conveyor through the working chamber, so as to direct air at said components perpendicularly across the conveyor, and the first screen also having a plurality of second orifices, each substantially larger than each of at least the majority of the first orifices, the second orifices being arranged in rows to either side of the array of first orifices and being directed convergently towards the conveyor so as to direct air convergently at the components simultaneously with the latter receiving air from the first orifices.

In such apparatus, where the conveyor is arranged to make a plurality of successive parallel passes through the working chamber, the first screen preferably has a said array of first orifices, flanked by a convergently-directed pair of rows of said second orifices, associated with each pass of the conveyor.

In a conventional rapid-cycle pin oven, the hot air delivery screen of the oven unit, through which the hot air is directed on to the moving can bodies in the working chamber, is permanently secured in the oven unit housing, as for example by welding. The thermal stresses set up in the structure of the unit, in operation, are considerable; so that both of the perforate screens are so secured so as to perform the functions of primary structural members. Such an arrangement does however present certain disadvantages, for example the inability to replace the screens by others having a different pattern or size of perforation, as may be required in respect of can bodies having differing sizes or shapes. We have found that, despite the thermal stresses involved in operation, it is not in fact essential that the perforate screens should be primary structural members as such; and that even if they do perform a structural role, they need not be permanently secured.

Thus the first screen preferably comprises a plurality of panels, removably secured to a frame which is fixed in the housing; these panels are preferably removably secured together so as to form together a rigid structure such that the fixed frame is a simple structure innocent of any cross-members, thus avoiding any interference with the air flow by the frame.

The other perforate screen or screens may also be in the same form.

In a thermal treatment apparatus according to the invention such as an oven, heating means will be provided for heating the treatment air. The heating means is preferably arranged in a side wall of the air recirculation chamber. The heating means may be electric or it may comprise a burner for gas or oil fuel. Preferably, it comprises a burner disposed in the air recirculation chamber at a position substantially above the level of the top of the working chamber.

In a preferred arrangement, the explosion relief means interconnecting the air recirculation chamber and the air delivery chamber is disposed partly to one side of the fan or blower and partly to the other side thereof, the heating means being disposed substantially opposite to the fan or blower.

The requirement for a scavenging air flow to remove volatile products, together with any products of combustion, has already been mentioned above. Besides providing a suitable inlet means for make-up air to compensate for treatment air lost in the scavenging flow, it is desirable also to provide a facility for rapidly cooling the interior of the housing in the event of an emergency.

Accordingly, the housing preferably has in a bottom wall thereof a substantially rectangular opening constituting a bottom opening of the working chamber, the conveyor being arranged to enter the working chamber at one end of the bottom opening and to leave it at the other end thereof, the bottom wall having a rapid-cooling shutter movable between a normal or closed position obturating a major part of the bottom opening, and an open position whereby to admit a surge of atmospheric air to the working chamber.

The temperature of the treatment air is preferably controllable so as always to have a predetermined value, or a value with a predetermined range, as best suitable for curing the particular coatings under treatment and with the conveyor running at the same speed as the coating or printing machine with which the apparatus is associated. This control may be achieved by means of a suitable thermostat or thermostats arranged within the oven unit housing, the thermostats being connected to an electrical control system including means for varying the heating rate of the heating means, for example by regulating the flow of fuel gas or oil to the burner. The response time of such an arrangement may, however, in some cases by unacceptably long.

Preferably, therefore, the temperature control system includes means for admitting controlled quantities of air into the interior of the housing, so as to enable the treatment air temperature to be reduced by a small amount when necessary to maintain the temperature at a predeterminedly acceptable value.

Accordingly, at least one of the said chambers, other than the working chamber, preferably has in a wall thereof a temperature-control aperture for communicating directly with the atmosphere, the temperature-control aperture having a controlled-cooling shutter movable between a closed position obturating the aperture and a fully-open position, the controlled-cooling shutter being arranged to be opend and closed so as to admit controlled quantities of make-up air for heating and recirculation as treatment air, and air for cooling the thermal treatment unit when required.

Actual control of the air flow through the temperature-control aperture is preferably achieved by modulating a fan which draws the make-up air into the housing.

The temperature-control aperture is preferably disposed in a bottom wall of the oven unit housing. It is also preferably arranged downstream of the working chamber but upstream of the heating means, so that the cold air can mix thoroughly with the hot air that has passed through the working chamber before itself being heated. To this end, in a preferred arrangement, where the said further chambers of the oven unit include an air recirculation chamber downstream of the working chamber, the temperature-control aperture is arranged in an external wall of the air recirculation chamber.

In preferred embodiments of the invention, where the housing of a process apparatus according to the invention is subdivided into a plurality of chambers at least one of which is a said superatmospheric chamber, each chamber is interconnected with at least one other of the chambers through internal explosion relief means. This is an important feature, whereby firstly the whole of the interior of the housing is available for explosive expansion and, secondly, the whole of its interior can become automatically vented upwardly and safely to atmosphere in the event of a catastrophic explosion.

According to the invention, in a second aspect, there is provided an explosion relief panel comprising a light, box-like casing open at its outer side and its inner side; an explosion panel of thin flexible sheet material within the casing and covering the open inner side of the casing; explosion panel securing means holding the edge only of the explosion panel, so that at least the greater part of the said edge is releasable under pressure applied to the explosion relief panel in excess of about 1.01 atmospheres; an outer cover of thin flexible sheet material overlying the open outer side of the casing; and outer cover securing means lightly locating the outer cover by only its edge so that the outer cover is releasable outwardly under said overpressure.

An embodiment of the invention will now be described, by way of example only, with reference to the drawings filed in this application, in which.

Figure 1:
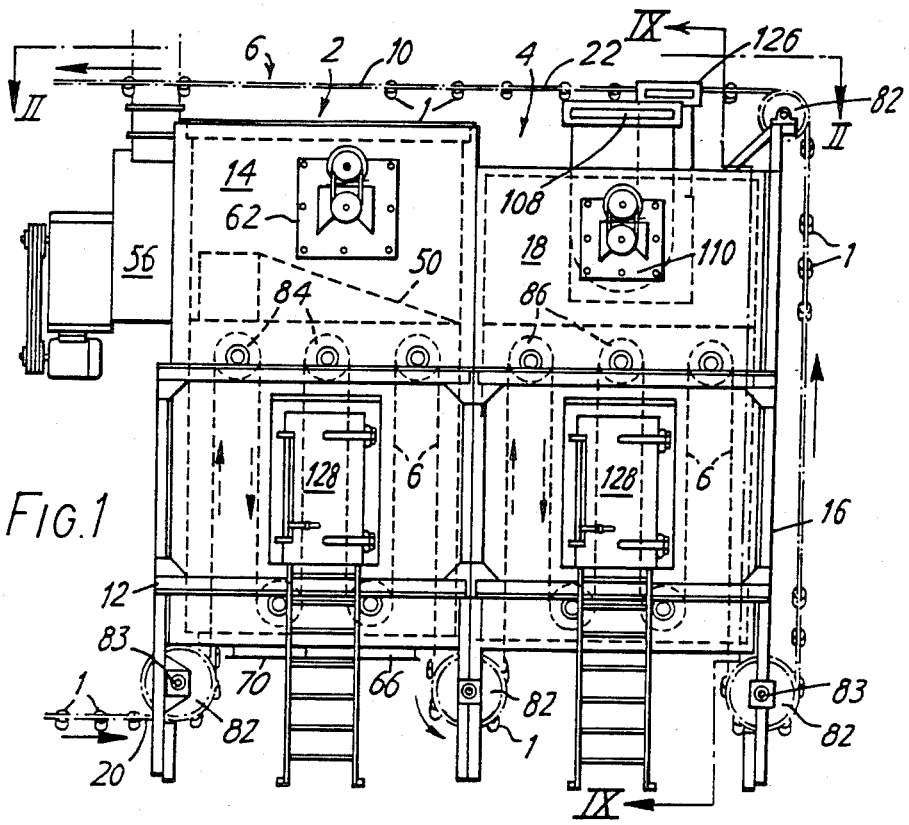
FIG. 1 is a side view of a rapid-cycle pin oven for curing coatings on a succession of metal can bodies, incorporating features of the invention, FIG. 1 being viewed in the direction I—I in FIG. 3.
Figure 10:
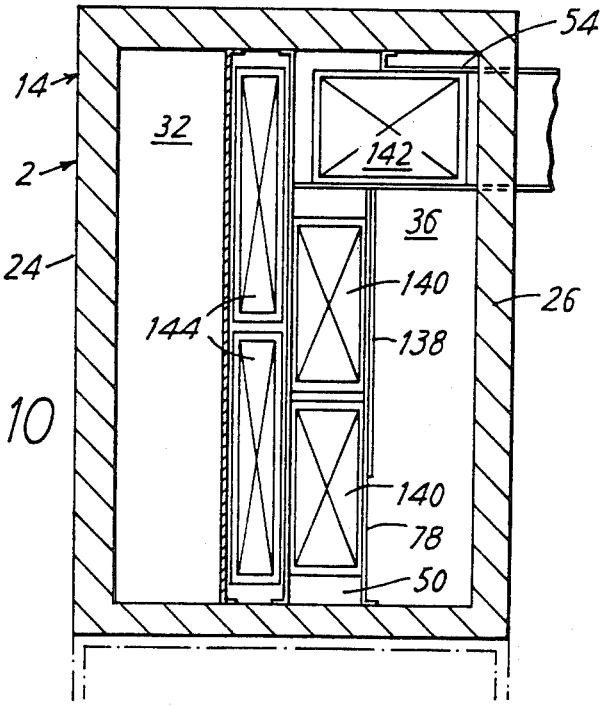
FIG. 10 is a simplified cross-sectioanl view of the oven unit, taken on the line X—X in FIG. 4.

The pin oven shown in the drawings is designed for the rapid treatment, by curing using hot air and subsequent forced cooling using cold atmospheric air, of coatings on a succession of hollow metal can bodies 1.

Figure 2:
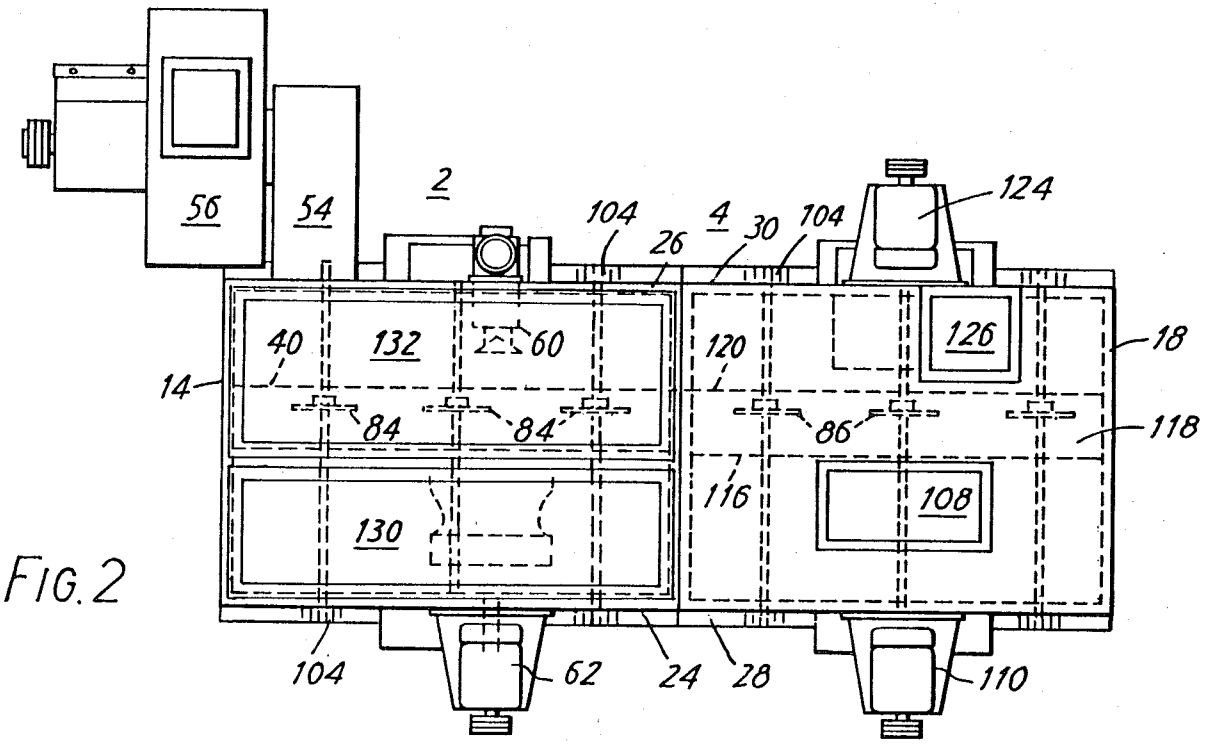
FIG. 2 is a simplified view looking down on the pin oven of FIG. 1, viewed in the direction II—II in FIG. 1 but with certain external parts of the appratus omitted.

Referring to FIGS. 1 and 2, the pin oven comprises a pair of air treatment units in tandem, viz, an oven unit 2 and a cooler unit 4, with a conveyor 6 which extends in succession through first the oven unit 2 and then the cooler unit 4, in a plurality of upward and downward passes in each case. The conveyor 6 comprises an endless chain 10 having laterally-projecting pins 8, which are not shown in FIGS. 1 and 2 but one of which can be seen in FIG. 5. The pins 8 are equally spaced along the conveyor chain 10.

Figure 3:
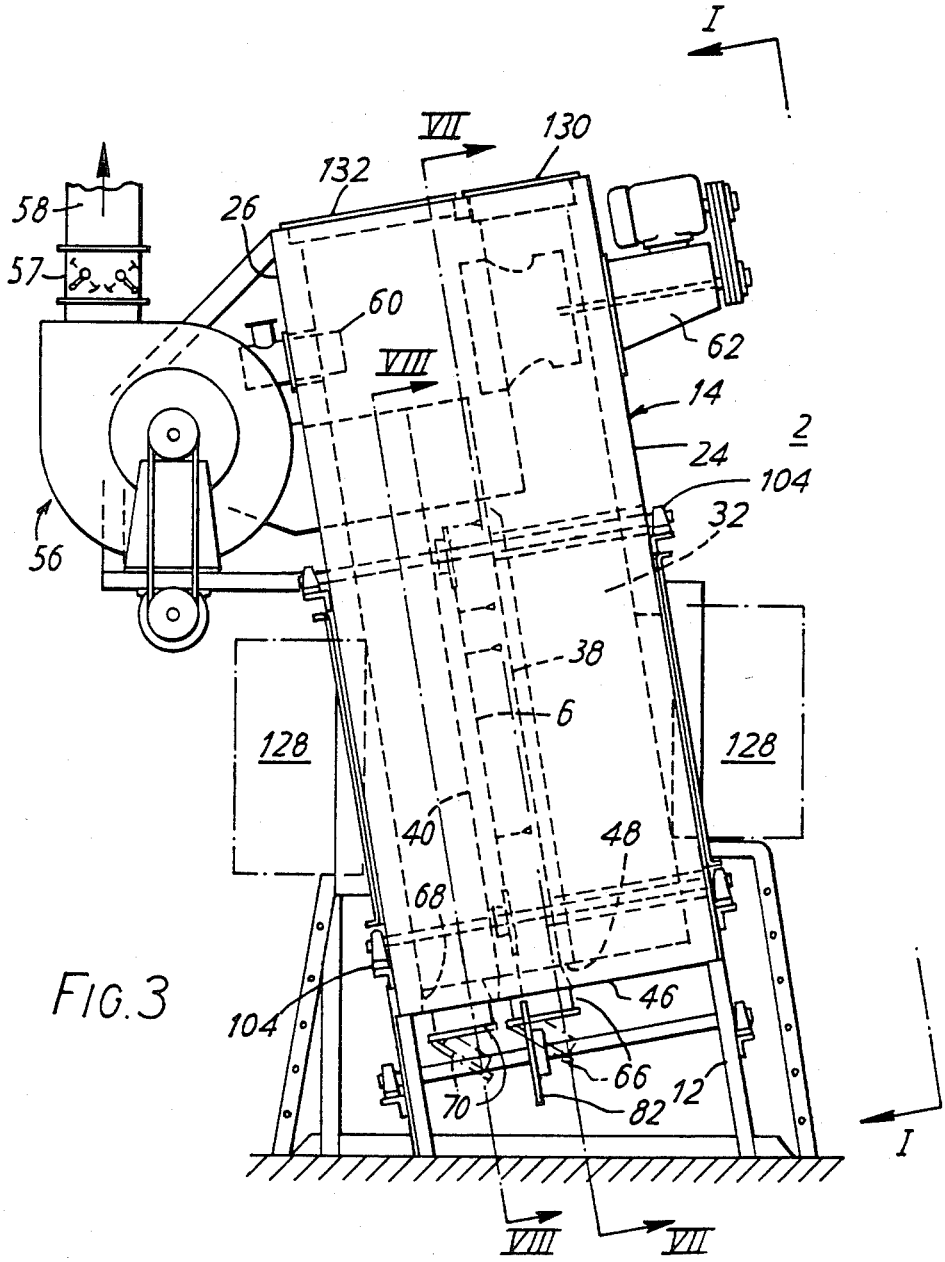
FIG. 3 is a simplified end elevation of the pin oven, viewed from the left-hand side of FIG. 1.

Referring now to FIGS. 1 to 3, the oven unit 2 comprises a rigid, floor-standing support frame 12 carrying a generally-rectilinear, enclosed housing 14 of the oven unit. Similarly, as can be seen from FIGS. 1 and 8, the cooler unit 4 comprises a similar support frame 16 carrying a generally-rectilinear, enclosed housing 18 of the cooler unit. The frames 12 and 16 are joined together in end-on abutting relationship to provide a single support structure for the pin oven. The two housings 14 and 18 are in abutting, endwise wall-to-wall relationship with each other, but may not be secured together, thus permitting differential thermal expansion to take place as between the units 2 and 4.

Figure 9:
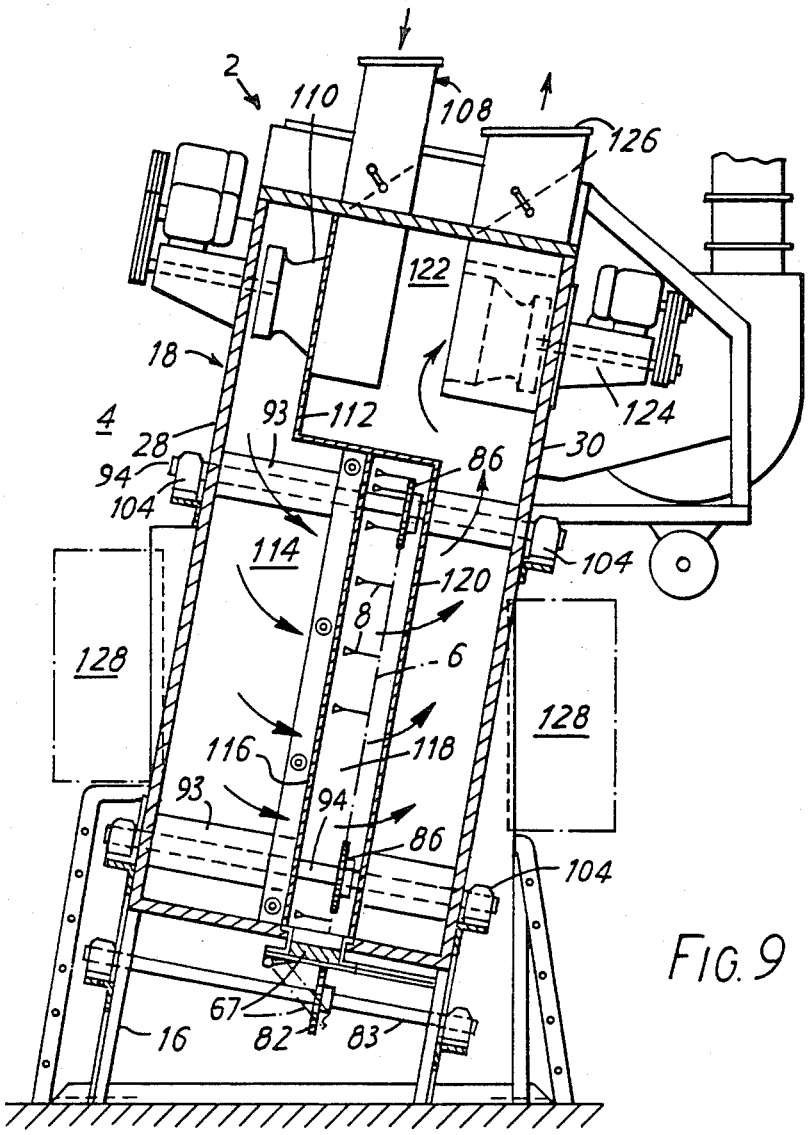
FIG. 9 is a simplified cross-sectional endwise elevation through a cooler unit of the pin oven, taken on the line IX—IX in FIG. 1 but with the horizontal external upper course of the conveyor omitted.
Figure 11:
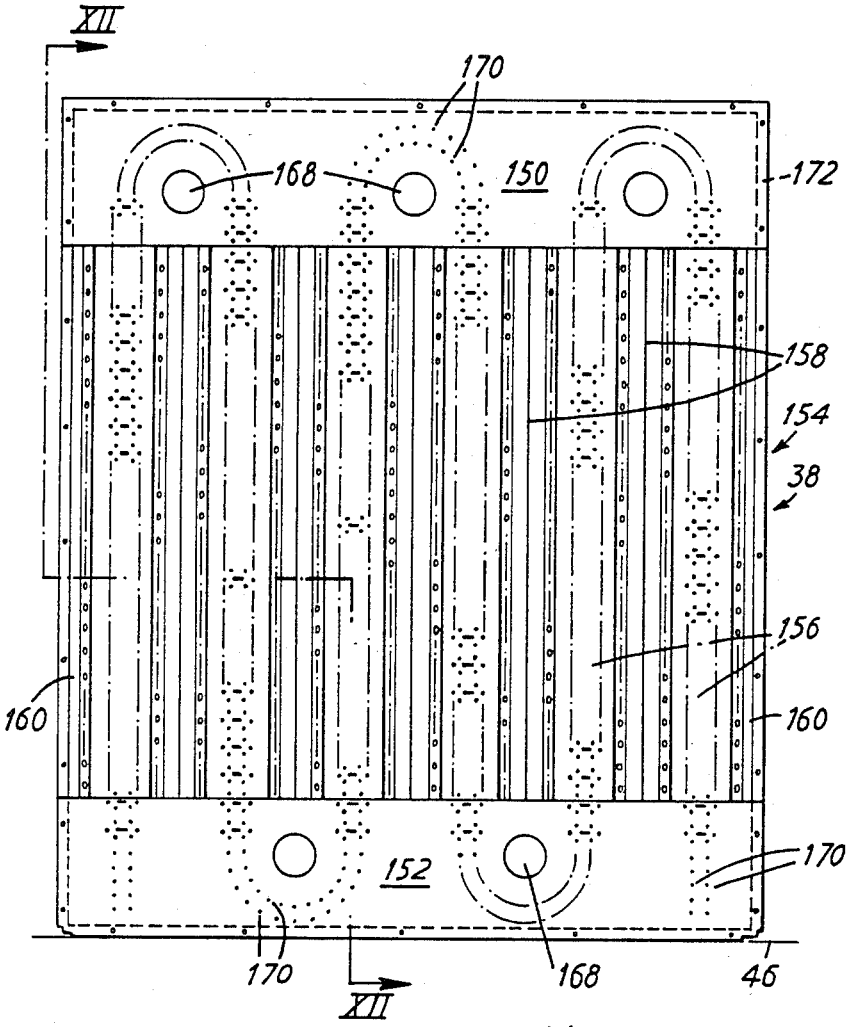
FIG. 11 is a view, in a direction corresponding to that indicated by the line VII—VII in FIG. 4, but showing a preferred form of air delivery screen.
Figure 12:
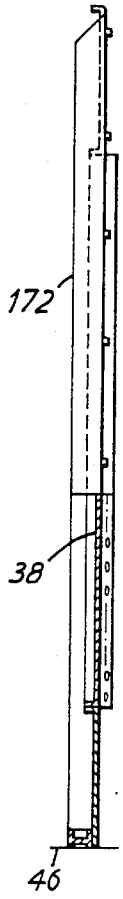
FIG. 12 is an endwise elevation, partly in section on the line XII—XII in FIG. 11, of the same screen.

The pin oven is arranged in a production line just downstream of a coater-decorator (not shown), which applies to the can bodies 1 the coatings to be cured in the oven. The conveyor 6 has a lower course 20 which brings the can bodies from the coater/decorator to the pin oven, and an upper or return course 22. In order that each can body 1 shall lie loosely over the respective pin 8 of the conveyor without falling off, the pins 8 are inclined upwardly with respect to the horizontal, and to this end the conveyor chain 10 itself is disposed in a plane inclined by the same amount with respect to the vertical. The whole of the housings 14 and 18 are similarly inclined, so that their side walls 24,25 and 28,30, respectively, are parallel with the plane of the conveyor 6. The frame 12,16 is constructed so as to provide rigid support for the oven in this sideways tilted attitude, which is evident from the endwise views of FIGS. 3 and 9.

Figure 8:
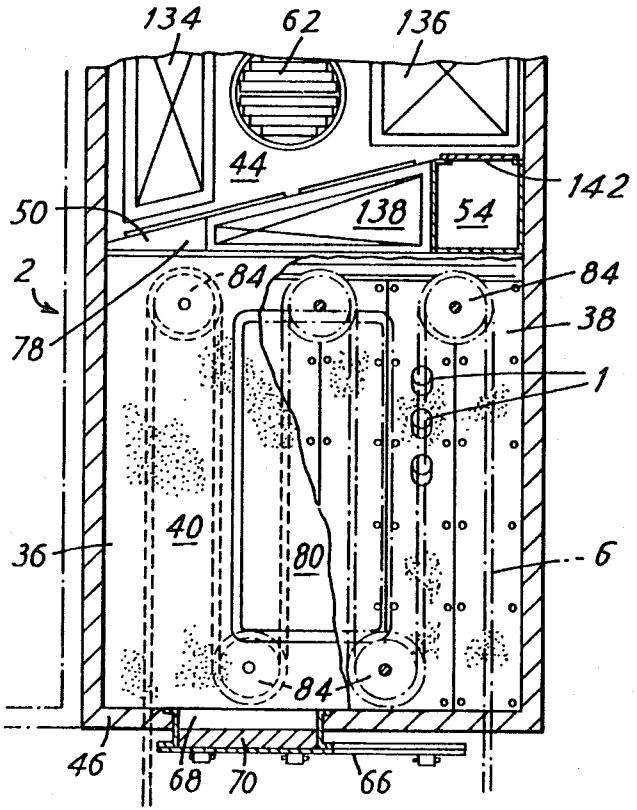
FIG. 8 is another longitudinal cross-sectional view of the oven unit, being taken on the line VIII—VIII in FIGS. 3 and 4, again with certain parts broken away.

Reference is now made to all of the Figures of the drawings. The oven unit housing 14 is subdivided into three compartments. These consist of a hot air delivery chamber 32, a working or curing chamber 34, and an air recirculation chamber 36, see FIG. 4. The working chamber 34 is defined between a pair of perforate screens comprising a first screen 38 for hot air delivery and a second screen 40 for air recirculation. The screens 38 and 40 lie in parallel planes, themselves parallel with the plane of the conveyor 6. As can be seen in FIG. 8, the latter extends through the working chamber 34 in three upward and three downward passes. The screen 40 is spaced laterally from the screen 38 by an amount such that the working chamber 34 is relatively narrow.

Figure 4:
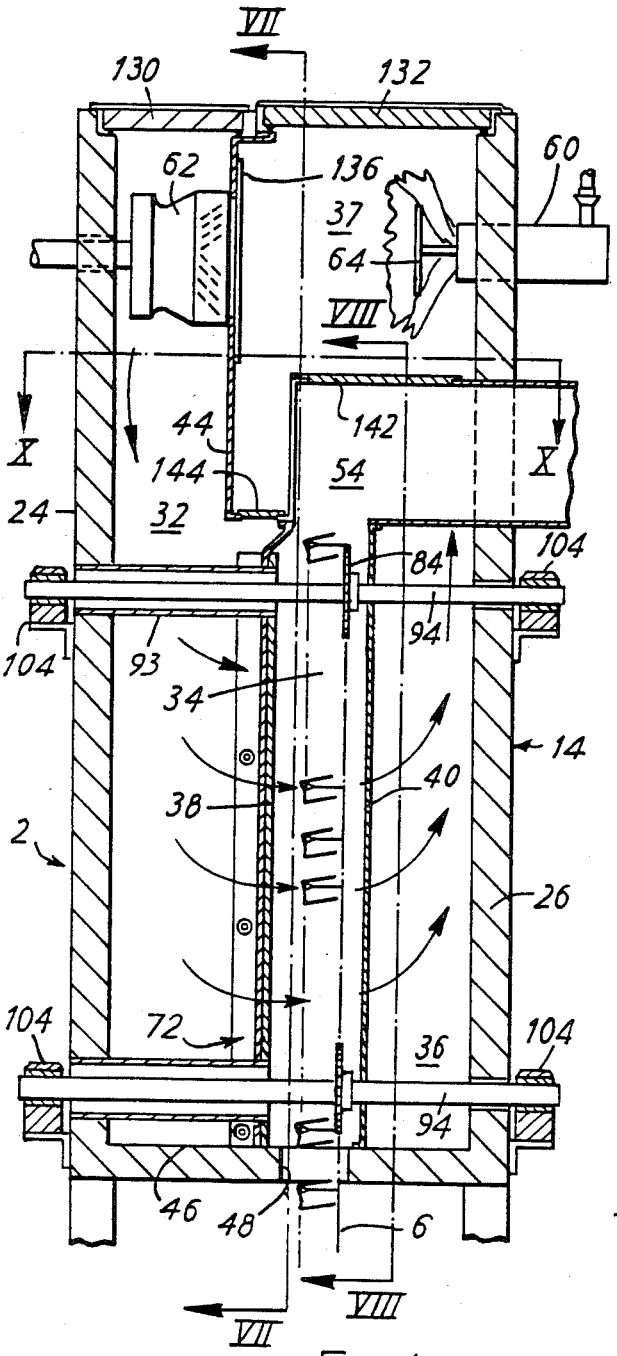
FIG. 4 is a simplified cross-sectional endwise elevation through the oven unit of the pin oven, taken on the line IV—IV in FIG. 6.

The hot air delivery screen 38 forms a partition between the delivery chamber 32 and the working chamber 34, the air recirculation screen 40 similarly dividing the latter from the recirculation chamber 36. The working chamber, as can be seen from FIG. 4, does not extend over the whole height of the housing 14, whereas both of the chambers 32 and 36 extend up to the top of the housing. Above the level of the delivery screen 38, a partition wall 44 extends over the length of the oven unit to separate the chambers 32 and 36 from each other. The wall 44 is fixed along its upper edge, and has at its lower end a transverse extension portion which meets the top edge of the screen 38, as can be seen in FIG. 4.

Figure 7:
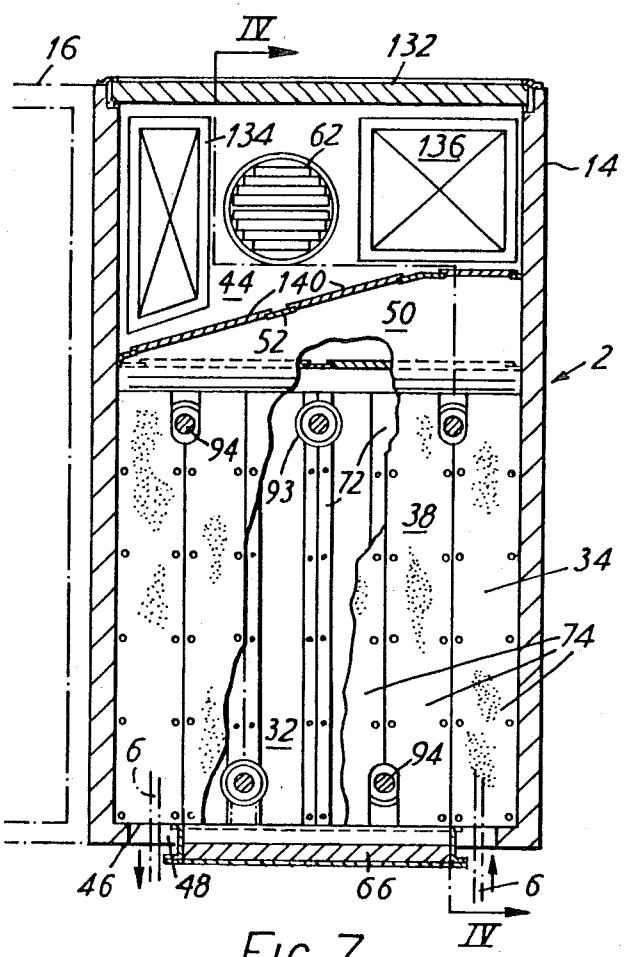
FIG. 7 is a longitudinal cross-sectional view of the oven unit, taken on the line VII—VII in FIGS. 3 and 4 but with certain parts broken away.

The working chamber 34, like the chambers 32 and 36, is bounded at the bottom by the bottom wall or floor 46 of the housing 14. The portion of the floor 46 below the working chamber 34 has a substantially rectangular slot 48, which extends over the greater part of the length of the chamber 34. As seen in FIG. 7, the endmost passes of the conveyor 10, in respect of the oven unit, respectively enter the working chamber from below, and leave it in a downward direction, through the slot 48 near the respective ends of the latter.

The working chamber 34 is open at its top into an extraction hood 50, FIGS. 7 and 8, which has an inclined upper wall 52 separating the working chamber from the upper part of the recirculation chamber 36. The hood 50 leads into an exhaust duct 54 which terminates in an oven extractor fan unit 56 (FIGS. 2 and 3). The fan unit 56 is fixed to the side wall 26 of the housing, and is coupled, through an exhaust damper 57, FIG. 3, with a stack 58 leading out of the building in which the pin oven is installed.

The lower part of the recirculation chamber 36 bounded by the recirculation screen 40, as can be seen, is open over the greater part of its length, past the hood 50, into an upper part 37 of the chamber which serves as a combustion space. For this purpose, a gas burner 60 is mounted in the outer side wall 26 of the housing 14 and projects into the combustion space 37. The burner 60 is arranged at a substantial height above the level of the top of the working chamber 34, and is close to half-way along the side of the oven unit.

Sealingly arranged in an opening in the partition wall 44, immediately opposite the burner 60, is the impeller of an oven air recirculating fan 62, whose motor is mounted externally on the outside of the oven unit housing 14. The burner 60 has a flame spreaded 64, whose function is partly to prevent flame from being directed straight into the recirculating fan 62, and partly to spread the flame to either side of the burner, so as to ensure more even heating of the air.

The recirculating fan 62, the successive chambers 32, 34 and 36, and the perforate screens 38 and 40, together constitute a means for circulating the treatment or process air heated by the burner 60 to cure the coatings on cans 1 as they are carried through the working chamber 34 by the conveyor 6. In the case of the oven unit 2, the greater part of the process air is recirculated, as will be seen hereinafter when operation of the pin oven will be described.

Returning to the slot 48 in the bottom of the working chamber 34, and referring to FIGS. 3 and 7, a rapid-cooling shutter 66 is mounted below the floor 46 of the housing in such a manner as, in its normal or closed position, to cover the greater part of the slot 48. That part of the latter not covered by the shutter 66 comprises a portion at each end of the slot large enough to permit the conveyor 6 to pass through when carrying the largest diameter of can body 1 which the pin oven is designed to handle. The rapid-cooling shutter 66 is movable between its closed position and a fully-open position. In the open position of the shutter 66, if the oven extractor fan is operating, a surge of cold atmospheric air is drawn upwardly into and through the working chamber 34, to effect rapid cooling, for example in the event of an emergency.

To assist in regulating the temperature of process air, the housing floor 46 has, in the bottom of the recirculation chamber 36, i.e. downstream of the working chamber 34, a temperature-control slot 68, FIG. 8. Hinged on the underside of the floor 46 is a controlled-cooling shutter 70, which, in its closed position, completely covers the slot 68. In any other position, it permits atmospheric air to be drawn into the chamber 36.

Referring now to FIGS. 4 and 7, a rigid screen support frame, diagrammatically shown at 72, extending over the length of the interior of the housing 14, is secured to the floor 46 and end walls of the housing. The delivery screen 38 comprises a number of individual, perforated plates 74, each secured removably to the frame 72.

The recirculation screen 40 is, in this example, permanently secured to the floor 46 and the end walls of the housing 14. Its top edge is welded to one side wall 78 of the extraction hood 50, which thereby forms a blind upward extension of the screen 40. However, a large, removable, perforated access panel 80 is secured to the fixed portion of the screen 40 by suitable quick-release fasteners (not shown).

The perforations through the screens 38 and 40 (including the removable access panel 80) may be of any suitable size and shape, and arranged in any desired pattern or orientation suitable for directing hot air onto the can bodies 1 and for passing the air through the recirculation screen 40. The preferred design of the delivery screen 38 will be described hereinafter.

The conveyor 6 includes external sprockets 82, each carried on a shaft 83, freely rotatable in bearings fixed to the oven and cooler frames 12 and 16 as appropriate. The conveyor chain 10 extends around these sprockets 82 and also around a set of internal sprockets 84 within the oven unit 2 and a further set of internal sprockets 86 within the cooler unit 4. In the embodiment shown in FIG. 6, each internal sprocket 84 has a central boss 88 which is a snug fit on a terminal cylindrical spigot 90 of a portion 92 of the sprocket shaft 94. The spigot 90 projects from an integral collar 96 of the shaft portion 92, and the shaft itself comprises the portion 92 and a further shaft portion 98 aligned with, and engaged removably (for example by a threaded coupling arrangement or a key and keyway) to the portion 92. The shaft portion 98 has an integral collar 100, and the sprocket 84 is held between the two collars 96 and 98 by a resilient tab washer 102.

Figure 6:
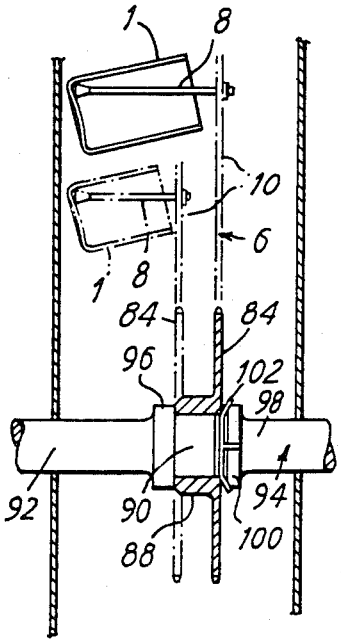
FIG. 6 is a view similar to FIG. 5 but showing a modification.

As can be seen from FIG. 6, the sprockets 94 may be reversed on their shafts, as between the position shown in full lines and that shown in phantom lines. In the former position, for longer can bodies 1, the boss 88 is pointing towards the delivery screen 38. The other position is for use with shorter can bodies. This enables the can bodies to be as close as possible to the hot air streams emerging from the screen 38.

A sprocket is reversed on its shaft by moving the shaft portion 98 axially away from the portion 92 to release the sprocket, which is then simply replaced in its new orientation and the shaft reassembled. While it is desirable to provide for reversal of the sprockets on the three external sprocker shafts 83, the length of the external courses of the conveyor extending from the coater/decorator to the pin oven, and upwardly from the bottom of the cooler unit (as seen on the right-hand side of FIG. 1) render such a facility unnecessary in respect of the remaining sprockets of the conveyor.

Figure 5:
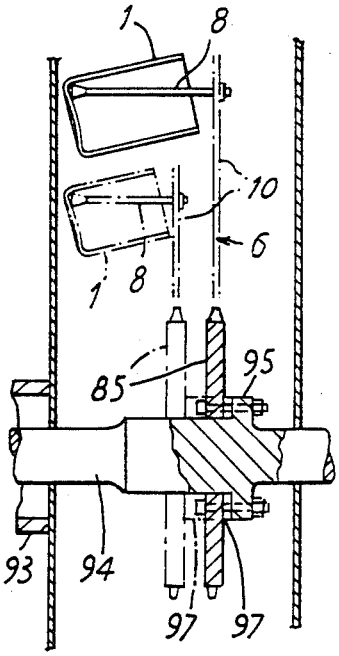
FIG. 5 is an enlarged scrap view, taken from FIG. 4 and showin an adjustment facility of the can conveyor of the pin oven.

FIG. 5 shows the preferred shaft and sprocket arrangement, in which each shaft 94 is in one piece and has a simple hub portion extending from a flange 95, the sprocket 85 being mounted around the hub and secured to the flange 95 through a washer 97 the length of which is chosen to put the sprocket in its correct axial position.

The facility for reversal or adjustment of the axial position, of the sprockets on their shafts is optional. If provided for the oven unit, it must of course also be provided for the cooler unit.

Each sprocket shaft 94 extends through a fixed shaft tube 93 across the delivery chamber 32, and is mounted in external bearings 104. Suitable openings are provided in the screens 38,40 to allow the shafts 94 to extend through them.

Turning to the cooler unit 4, some features of this unit have already been specifically mentioned above. Its construction is generally similar to the oven unit 2, and therefore need not be described in detail. The cooler unit differs from the oven unit principally in that (a) it uses cold atmospheric air instead of hot air, and (b) the air is not recirculated but is forced across the working chamber in a single pass. To this end, and referring to FIG. 9, the cooler unit housing 18 has an air inlet duct 108 leading into an air circulation or inlet fan 110 which is mounted in a partition wall 112 corresponding with the partition wall 44 of the oven unit (FIG. 4). The fan 110 forces the cold air down through the cold air delivery chamber, 114, and thence through a perforate cold air delivery screen 116 and across the relatively narrow working or cooling chamber 118. The air leaves the cooling chamber by passing through a perforate air circulation screen 120 into the exit chamber 112, from which it is removed by an exhaust fan 124 to an air outlet 126. The similarity between the various components and compartments of the cooler unit and their equivalents in the oven unit will be self-evident from the drawings.

The cold air delivery screen 116 may be constructed in the same manner as is the hot air delivery screen 38 of the oven unit. In this example the delivery screen 116 is not bolted in position but welded, whereas the recirculation screen 120 is bolted in position.

A rapid-cooling shutter 67 is provided in a slot in the bottom of the working chamber 118, its purpose and operation being generally the same as those of the corresponding shutter 66 of the oven unit.

Both the oven unit 2 and the cooler unit 4 are provided with external access doors 128, in the respective side walls 24,26,28,30 of the housings. The access doors 128 are hinged on vertical axes.

The mode of operation of the pin oven will be largely self-evident from the foregoing description. The coated can bodies 1, with the coatings as yet uncured, are brought into the working chamber 34 of the oven unit by the conveyor, which is in continuous forward movement at a constant velocity. The treatment air, heated by the burner 60, is driven downwards with the products of combustion by the oven air recirculating fan 62 through the hot air delivery scrren 38, which directs the air from its perforations directly onto the can bodies within the working chamber. On its way across the latter, the hot air is in turbulent flow and penetrates over the whole of the exposed surface of each can body. The coatings, as they become cured under the hot air, yield volatile products. These are scavenged, together with some of the process air and combustion products, by a stream of air drawn by the extractor fan 56 upwardly from the working chamber and out through the extraction hood 50 and exhasut duct 54. Make-up air to compensate for the resulting loss of treatment air is drawn in partly through the open end portions of the slot 48 through which the conveyor 6 enters and leaves the working chamber, and partly through the temperature-control slot 68 when the controlled-cooling shutter 70 is open. On leaving the oven unit, the hot can bodies are immediately carried by the conveyor 6 through the cooler unit 4, the operation of which has already been described. Such treatment air in the working chamber 34 as is not extracted in the scavenging stream is recirculated through the recirculation screen 40 and up through the recirculation chamber 36, to be reheated in the combustion space 37 before passing back to the working chamber.

The temperature within the curing chamber may be continuously monitored by thermostats (not shown), connected in a suitable control system arranged to open and close the exhaust damper 57 by appropriate amounts to modulate the exhaust fan 56 and so vary the flow of cold air into the recirculation chamber. The control system may also be arranged to operate a variable-flow gas valve (not shown) in the gas supply line to the burner 60, and to control the rapid-cooling shutter 66 so that the latter is opened in the event of a rapid increase of temperature (for whatever reason) above a predetermined danger level. The control system can also be arranged to close the gas valve under these circumstances, whether the latter is of the variable-flow type or not.

It has been seen that the working chamber 34 is in communication with the hot air delivery chamber 32 and the air recirculating chamber 36 through the perforate screens 38 and 40 respectively; and that the chambers 32 and 36 communicate with each other through the hot air recirculating fan 62. These means of communication are however somewhat restricted, and are entirely inadequate in the event of an explosion within any one of the three compartments of the oven unit. Under these circumstances the resulting pressure wave will not be dissipated fast enough to avoid a high probability of bursting of the external walls of the housing. For this reason, each of the chambers 32 and 36 is provided with external explosion relief means in the top of the housing, to vent the respective chamber direct to atmosphere. The external explosion relief means of the chamber 36 comprises an external explosion relief panel 132, FIGS. 2, 4 and 7; that of the delivery chamber 32 consists of a relief panel 130. The panels 132, 130 are described hereinafter.

Each of the oven unit chambers 32, 34 and 36, is interconnected with at least one of the others through internal explosion relief means, consisting of blow-out panels which occupy a high proportion of all of the various partitions between the chambers, other than the perforate screens 38 and 40. Thus the combustion space 37 has explosion relief into the hot air delivery chamber through blow-out panels 134 and 136 lying on either side of the oven air recirculating fan 62.

A pair of blow-out panels 144, in the transverse lower portion of the partition wall 44, provides explosion relief from the delivery chamber 32 into the combustion space 37. The working chamber 34 has explosion relief into the recirculation chamber 36 through two blow-out panels 140 in the sloping upper wall 52 of the extraction hood 50, and a further blow-out panel 142 in the top of the exhaust duct 54.

However, in the event of an explosion in any of the chambers 32, 34 or 36 generating sufficient pressure to cause one or more internal blow-out panels to operate, the pressure is relieved through the resulting opening. If internal blow-out panels operate such as to interconnect all of the chambers, then the entire interior of the oven unit is at once vented to atmosphere through one or both of the explosion relief panels 130, 132.

It will be realised that, where there is more than one internal blow-out panel between any two chambers, one or more of the panels may be adapted to blow out in response to a pressure surge in one of the chambers, i.e. to detach into the other chamber, whilst the or each of the remaining panels is adapted to blow out if the pressure surge is in that other chamber. Thus for example, of the two blow-out panels 140, one may be arranged to blow upwards to relieve pressure in the working chamber 34, the other to blow downwards if there is an explosion in the combustion space 37.

Reference is now made to FIGS. 11 to 14, showing the preferred form of air delivery screen 38. This construction can also be used for the delivery screen of the cooler unit.

In this embodiment, the delivery screen frame, 172, which is welded into the housing 14 (not shown in these Figures), comprises a simple rectangular frame of channel-section steel, with no intermediate cross-members or vertical struts or ties. The screen 38 comprises a number of panels, consisting of a top orifice plate 150, a bottom orifice plate 152 and a large centre section 154. The section 154 comprises a pair of end orifice plates 160 between which are mounted, alterntely, flat orifice plates 156 and double inclined orifice plates 158. All of the plates (panels) of the centre section 154 are mounted vertically (FIG. 11), and in plan cross-section they have the form shown in FIG. 14, each with side flanges 162. The flanges 162 of adjacent plates are bolted together; while the outer side edges of the end plates 160, and those edges of the top and bottom plates 150,152 not adjacent the centre section 154, are all bolted to the frame 172. The ends of the orifice plates 156, 158 and 160 are also flanged, as at 164, FIGS. 13 and 14; and these flanges are bolted to flanges of the plates 150,152. The screen 38 with its frame 172 thus forms a rigid structure which can nevertheless be dismantled for maintenance or repair, or for substitution of orifice plates of different orifice patterns if required.

Figures 13, 14:
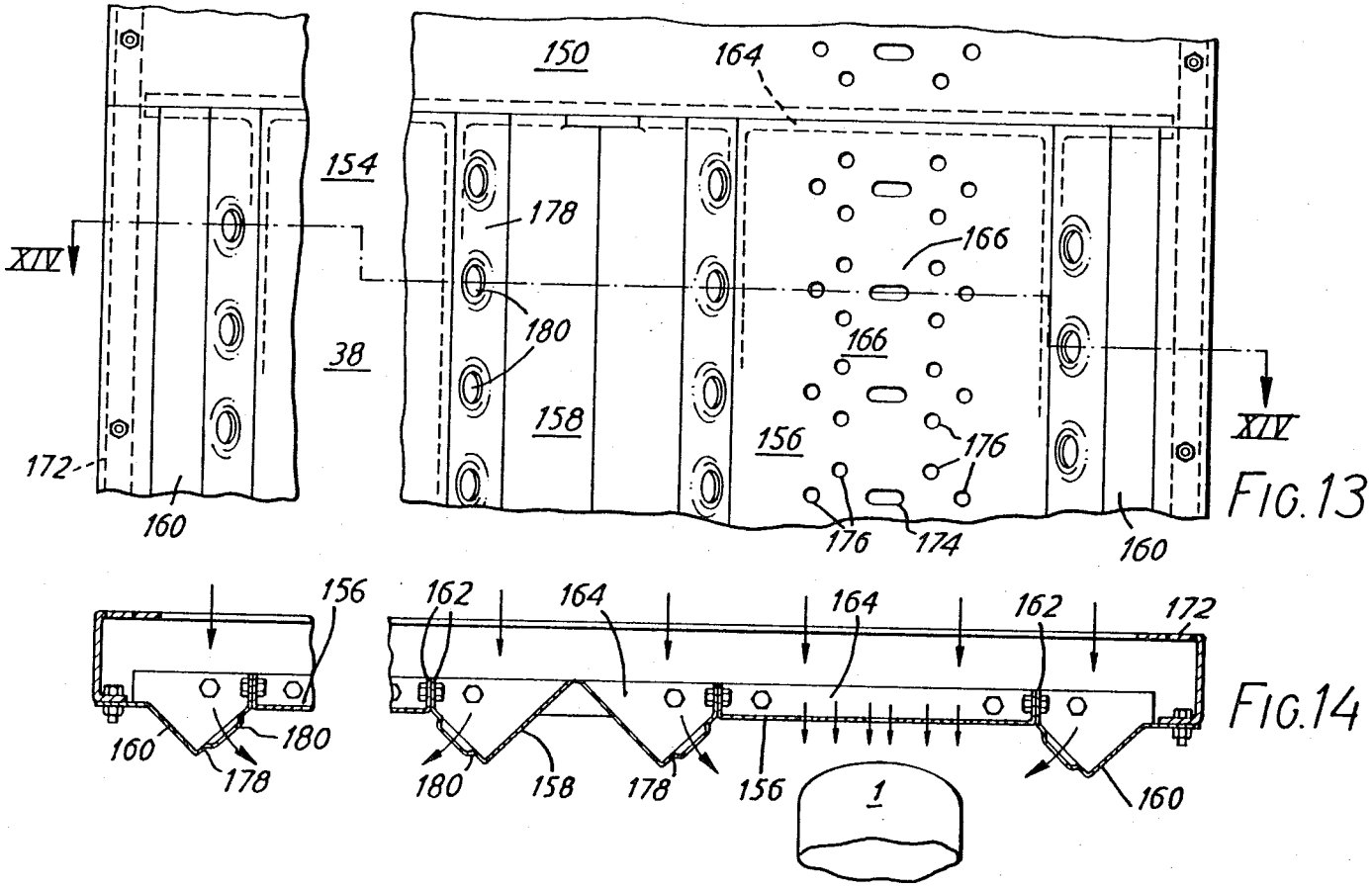
FIG. 13 is an enlarged view corresponding to part of FIG. 11.
FIG. 14 is a sectional plan view taken on the line XIV—XIV in FIG. 13.

The top and bottom orifice plates 150 and 152 have holes 168 through which the sprocket shafts 94, already described, extend. All the orifice plates have through orifices for delivery of the treatment air to the can bodies 1, one of which is indicated in FIG. 14, carried by the conveyor. The conveyor is not shown, but is arranged as previously described and illustrated in earlier Figures. Aligned with the path of the conveyor chain, so that they directly face the conveyor in a direction at right angles to the plane of the screen 38, is an array of first orifices having their axes perpendicular to the plane of the screen. These first orifices consist of groups 166 of orifices formed in the flat plates 156; a few similar groups 166 in the plates 150,152; and pairs of simple holes 170 formed in the plates 150 and 152 and arranged around the shaft holes 168 and opposite the bottom entry and exit paths of the conveyor chain. The array of first orifices 166,170 thus lies parallel with, and provides an air flow over, the whole of the path of the conveyor through the oven unit. In some embodiments it may not be necessary to provide air flow over the whole path, but it must be provided over at least the greater part thereof.

Each group of orifices 166 consists of a central transverse slot 174 flanked by two groups of circular holes 176, each group of holes 176 being arranged on an equilateral triangle. The diameter of each hole 176 and 170 is typically 8 mm.

The orifice plates 158 and 160 have walls 178 inclined to the plane of the screen by 45°. Each wall 178 has a row of second orifices 180, each directed at 45° to the path of the conveyor. As can be seen from FIG. 14, the array of first orifices 166 is flanked, in the centre section 154, on both sides by rows of the orifices 180, which thus direct air convergently towards the conveyor, so that each can body 1 receives air convergently from the orifices 180 simultaneously with the air stream from the first orifices.

The orifices 180 are substantially larger than the holes 176,170 which constitute the majority of the first orifices. Typically each orifice 180 may have a diameter of 18 or 19 mm.

The various orifices function in the manner of nozzles, and as seen in FIG. 13 they are arranged at regular pitches: in this example the orifices 180 of the plates 158 are level with the slots 174, while the orifices of the end plates 160 are staggered by half a pitch from the level of each slot 174.

Turning now to FIGS. 15 to 18, it will have been realised from the foregoing description of operation of the oven unit that the working and recirculation chambers 34,36 are, in normal operation, at a superatmospheric pressure. This normal working pressure is in the range 1 to 1.01 atmosphere, i.e. in no sense can the housing 14 be regarded as a "pressure vessel" as the term is normally used. The top part of the delivery chamber 32, on the other hand, is, in normal operation, at a pressure slightly below the ambient pressure. Thus, the external explosion relief panel 130 provided on the chamber 32 may take any conventional form suitable for situations where the internal pressure is subatmospheric. In the particular form shown in FIG. 15, the panel 130 rests on a seal 182 around the opening 184 formed in the top of the housing 14, and is retained by its own weight and by the partial vacuum within the chamber 32. The panel 130 is of strong but lightweight construction and comprises a simple steel tray 186 containing a relatively thin mattress 188 of mineral wood, filling the lower part of the tray, above which the side wall of the tray has slots 190 for pressure relief. The top of the tray 186 is covered by a very light cover 192, whilst its bottom 194 is formed of expanded metal or otherwise perforated. In the event of an explosion or the internal pressure in chamber 32 becoming superatmospheric for any other reason, the pressure can be released first through the mattress (which may lift), and the slots 190, then by the cover 192 lifting, and finally, in a more severe case, by the whole panel 130 being lifted.

Figures 15, 16, 17, 18:
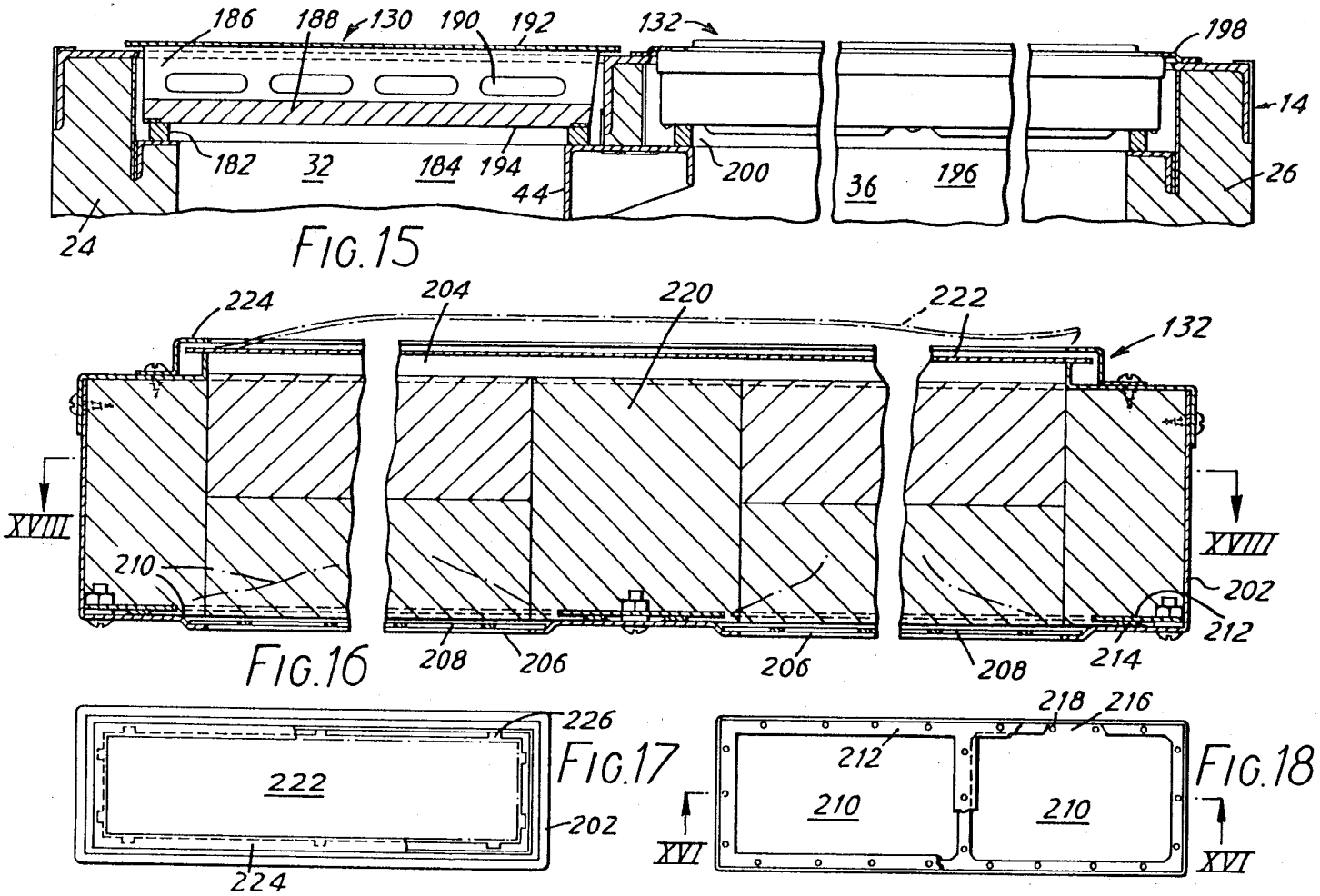
FIG. 15 is an enlarged version of the top part of FIG. 4, showing the mounting of external explosion relief panels of the oven unit.
FIG. 16 is a sectional elevation of an explosion relief panel according to the invention (also seen in FIG. 15 in outside elevation), taken on the line XVI—XVI in FIG. 18.
FIG. 17 is a top plan view (with part of one component broken away) of the same relief panel.
FIG. 18 is a sectioanl elevation on the line XVIII—XVIII in FIG. 16, with an internal mattress of the panel removed and an explosion panel retaining frame shown partly broken away.

The external explosion relief panel 132, which is seen in greater detail in FIGS. 16 to 18, is intended primarily for use where the working pressure inside the associated chamber is in the superatmospheric range up to about 1.01 atmosphere, as in chamber 36, the panel being designed to "blow" at about 1.015 atmosphere. The panel 132 is lightly but sealingly held, in its through aperture 196 in the top of the housing 14, by a light retaining frame 198 co-operating with a bottom seal 200 surrounding the aperture 196.

The panel 132 comprises a light, box-like casing 202 open at its upper or outer side 204 and at its lower or inner side 206, the opening 206 being (in this example) in two halves, each of which has secured within it a protective sheet of expanded metal 208. Overlying the sheets 208 are a pair of explosion diaphragms or panels 210 of thin metal such as tinplate or stainless steel.

The thickness of the explosion panels or diaphragms 210 is similar to that typically used for metal cans used in packaging, for example in the range 0.005 to 0.015 inch (0.12 to 0.38 mm), and one suitable thickness for tinplate is 0.008 inch (0.20 mm). The diaphragms 210 are secured by a frame 212, which holds the edge only of the diaphragms as seen in FIGS. 16 and 18. Between the frame 212 and the edge of each sheet 210 is a rope gasket 214 which serves as a friction element to provide a known frictional resistance to release of the diaphragm 210 under overpressure conditions. Optionally each diaphragm 210 may have a portion 216, FIG. 18, which is positively secured (in this example by two of the bolts 218 securing the frame 212 to the casing 202) so as to retain the diaphragm in the casing 202 while still allowing it to perform its function. In the event of an explosion, the explosive force will force the edges of the flexible diaphragms 210 out from under the frame 212, against the resistance of the gasket 214, and may even rupture the diaphragms themselves as indicated by phantom lines in FIG. 16.

Above the explosion panels or diaphragms 130 is a thick mattress 220 of light, energy-absorbing material, such as the mineral wool sold under the Trade Mark ECOMAX 337. The mattress 220 virtually fills the casing 202.

The open top 204 of the casing 202 has, resting lightly on it, a top cover 222 of a light, flexible, thin sheet material (such as that sold under the Trade Mark KLINGER SIL C4400). The top cover is lightly located, by its edge only, by a surrounding top cover retaining member 224 carried by the casing 202.

In an explosion, after release and/or rupture of the explosion panels 210, the mattress 220 absorbs some of the pressure energy but is also dislodged upwardly, while the top cover 222, being flexible, is forced out from under the retaining member 224. However, the only element likely to be dislodged completely from the panel 132 is the top cover (and even this will not necessarily occur, due to a series of small edge projections 226, FIG. 17, which are provided on the cover 222 and which tend to restrict the extent to which the cover is completely separated from the panel 132).

It will be realised that the panel 132 operates by successive deformation of the elements 210,220, and 222, which absorbs some of the energy of the explosion while quickly venting chamber 36 to atmosphere.

In explosion conditions, the panel 132 will tend to act before the panel 130 since the air flow in operation is towards the former and away from the latter.

What is claimed is:

1. An explosion relief panel, for closing an aperture in a wall of an enclosed housing and having an outer side for facing outwardly of said wall and an inner side for facing into said housing, said explosion relief panel comprising a light, box-like casing (202) open at its outer side (204) and its inner side (206); an explosion panel (210) of thin flexible sheet material within the casing and covering the open inner side of the casing; explosion panel securing means (212) releasably clamping the edge only of the explosion panel inside the casing, so that at least the greater part of the said edge is releasable under pressure applied to the explosion relief panel in excess of about 1.01 atmospheres; a mattress (220), of light, energy-absorbing material for absorbing a portion of said energy, overlying the explosion panel (210); and an outer cover (222) of thin flexible sheet material overlying the open outer side of the casing; and outer cover securing means (224) retaining the outer cover captive with the casing by only its edge so that the outer cover is releasable outwardly under said overpressure.

2. An explosion relief panel according to claim 1, characterized in that the explosion panel securing means includes a friction element or gasket (214) around the edge of the explosion panel (210), selected so as to provide a predetermined frictional resistance to the release of the explosion panel.

3. An explosion relief panel according to claim 1, characterized in that the explosion panel (210) is of steel, the outer cover (222) being of a flexible, non-metallic composite material.

4. An explosion relief panel according to claim 1 wherein the securing means for the outer cover comprises a frame having an opening smaller than the outer cover for retaining the cover with the casing without restricting lateral movement of the outer cover.

5. An explosion relief panel according to claim 1 wherein the casing is separate from the housing.

* * * * *